US008490399B2

(12) United States Patent
Nordlund

(10) Patent No.: US 8,490,399 B2
(45) Date of Patent: Jul. 23, 2013

(54) THERMALLY ISOLATED WALL ASSEMBLY

(75) Inventor: Raymond S. Nordlund, Orlando, FL (US)

(73) Assignee: Siemens Energy, Inc., Orlando, FL (US)

( * ) Notice: Subject to any disclaimer, the term of this patent is extended or adjusted under 35 U.S.C. 154(b) by 348 days.

(21) Appl. No.: 13/027,316

(22) Filed: Feb. 15, 2011

(65) Prior Publication Data

US 2012/0204727 A1 Aug. 16, 2012

(51) Int. Cl.
*F02G 3/00* (2006.01)

(52) U.S. Cl.
USPC ..... 60/752

(58) Field of Classification Search
USPC ..... 60/752
See application file for complete search history.

(56) References Cited

U.S. PATENT DOCUMENTS 4,471,623 A * 9/1984 Griffin ..... 60/752
2009/0013695 A1 1/2009 Dierberger et al.
2010/0077719 A1 4/2010 Wilson et al.

* cited by examiner

*Primary Examiner* — Robert A Hopkins

(57) ABSTRACT

A wall assembly (30) for separating a first fluid at a highest pressure and lowest temperature outside (86) the wall assembly from a second fluid at a lowest pressure and highest temperature inside (88) the wall assembly. The wall assembly (30) having: a structural cold wall (32) for exposure to the first fluid and partly defining a first cavity (78), and a structural cold wall aperture (42) for creating a first pressure drop (52); a structural middle wall (34) partially defining the first cavity (78) and partially defining a second cavity (84), and a structural middle wall aperture (44) for creating a second pressure drop (54); and a floating wall (38) for exposure to the second fluid and partially defining the second cavity (84), and a floating wall aperture (46) for creating a third pressure drop (56).

27 Claims, 1 Drawing Sheet

THERMALLY ISOLATED WALL ASSEMBLY

FIELD OF THE INVENTION

The invention relates to construction of thermally loaded components. Specifically, this invention relates to construction of highly thermally loaded gas turbine engine components subject to high mechanical loads resulting from interior pressure differentials.

BACKGROUND OF THE INVENTION

Conventional gas turbine engines discharge combustion gasses from a combustor to a transition which directs the combustion gasses to the first stage of the turbine. The combustion gasses inside the transition are traveling faster than the pressurized air outside of the transition. This creates a relatively low pressure inside the transition compared to outside the transition. This pressure difference generates a mechanical load which the transition must bear. These mechanical loads must be borne at the same time the transition bears the thermal loads created by the hot combustion gasses inside the transition and the relatively cooler air outside the transition. Some new transition technologies are increasing combustion gas speeds and consequently creating a need for gas turbine engine component structures that can withstand greater mechanical loads while also handling greater thermal loads.

BRIEF DESCRIPTION OF THE DRAWINGS

The invention is explained in the following description in view of the drawings that show.

DETAILED DESCRIPTION OF THE INVENTION

Combustion gasses traveling in conventional gas turbine engine transitions commonly travel at speeds up to mach 0.3. Conventional transitions have been developed that can handle the mechanical loads generated by combustion gasses traveling at mach 0.3, but some emerging technologies may produce greater combustion gas speeds which would generate greater mechanical loads that may exceed the capacity of conventional transition designs. The increased speed of the combustion gas in transitions using these emerging technologies results in higher heat transfer coefficients and greater pressure differences from outside the transition to inside the transition. Consequently, these new technology transitions require improved thermal capacity while simultaneously requiring improved mechanical load capacity resulting from the greater pressure drop.

A recent design innovation, as disclosed in co-pending and commonly assigned U.S. patent publication no. 201000077719 to Wilson et al., filed on Apr. 8, 2009 and incorporated by reference herein, replaces the conventional transition, seals, and vanes with an assembly of flow directing structures that transports expanded gasses from each combustion chamber to an annular chamber. In the annular chamber the previously discrete flows are no longer separated from each other by walls but are united into a single annular flow prior to entering the first stage turbine blades. By using fewer seals, aerodynamic losses due to seals are reduced. The newer design uses the entire length of the duct to properly orient the flow, while the designs of the prior art used vanes at the end of the duct to orient the flow, which resulted in a relatively abrupt change in the flow direction, and associated energy losses. Further, this newer design reduces costs associated with assembly and maintenance.

Figure 1:
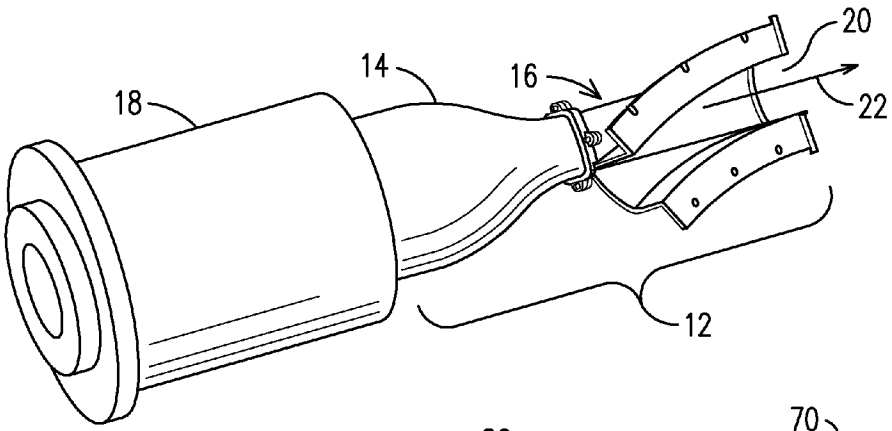
FIG. 1 is a single flow directing structure.

A single flow directing structure of the assembly of commonly assigned U.S. patent publication no. 201000077719 to Wilson et al. is shown in FIG. 1 and is representative of emerging technology that is placing increased demands on the structural and thermal load capacity of gas turbine engine components. The assembly is a collection of flow directing structures 12, one for each combustor can 18, and each flow directing structure may comprise a cone 14 and an integrated exit piece (IEP) 16. Alternately, each flow directing structure may be a single component. A cross section of the cone 14 is substantially reduced as the combustion gasses travel in a downstream direction. Consequently the cone is subject to high thermal stress along its entire cone longitudinal axis 22. This reduction of a gas flow path cross sectional area is significantly greater in this design than in conventional gas turbine engine transition design, but the mass flow rate of combustion gasses remains comparable. The same mass flow rate of combustion gas flowing through a gas flow path with a reduced cross section results in an increase in the speed of the combustion gasses during transit to the first row of blades. The increased combustion gas flow speed reduces pressure inside the flow directing structure. This increased pressure difference results in a greater mechanical load across the flow directing structure. For example, a mach 0.3 combustion gas flow may create approximately a 3% total drop in pressure from outside the transition to inside the transition. A mach 0.8 combustion gas in a flow directing structure 12, such as in FIG. 1, may create approximately a 30% drop in pressure from outside the IEP 16 to inside the IEP 16, producing considerably greater mechanical load. Furthermore, the higher velocities generate higher heat transfer coefficients, thereby increasing the thermal load on the transition. The increased mechanical loading together with the increased thermal loading may approach, if not exceed, the capacity of conventional single and double wall transition technology.

The present inventor has conceived of an innovative wall structure capable of handling both the increased mechanical load and the increased thermal load of the new technology flow directing structure 12. In the innovative wall structure the mechanical loads induced by pressure differences are borne primarily by the structural components of the wall, while the thermal loads are borne primarily by the thermal components. Furthermore, the junction between the structural components and the thermal components is configured so that the mechanical loads borne by the structural components are essentially isolated from the thermal components, and the thermal loads born by the thermal components are essentially isolated from the structural components. Specifically, the floating wall elements of the floating wall are not solidly affixed to the structural components (i.e. welded etc), but instead are trapped, and free to float, and expand and contract in response to thermal loads and gradients.

This configuration may produce several advantages. For example, the assembly uses apertures in respective walls to control a pressure drop across each respective wall. Apertures like these may also be required to provide cooling air for the walls and/or other walls or elements, such as impingement cooling. However, a pattern optimized for creating a certain pressure drop may not be optimal for cooling. A three wall configuration permits two of the walls to bear a majority of any pressure related mechanical load, while aperture patterns in each of the structural walls can be tailored for a desired task. For example, apertures through a cold, structural outer wall may be patterned to produce a desired larger pressure drop, while apertures through a middle structural wall may be tailored to provide impingement cooling of the inner, hot wall. Thus, while apertures in both structural walls would be achieving a pressure drop and cooling in each wall, each wall could be optimized for one task over the other. In short, having multiple structural walls enables a greater choice of aperture patterning and permits both optimal pressure drop control and cooling control not available in prior designs.

In addition, during operation thermals may tend to drive the mouth region 20 of the IEP 16 open and/or closed, which is undesirable for aerodynamic reasons. The stronger wall assembly may reduce this phenomenon. Also, the floating wall elements are modular, which means they can be replaced as needed, as opposed to replacing the entire IEP 16 should there be damage to the floating wall, which produces a savings in time and materials. Further, task specific materials can be chosen for the floating wall elements and for the remaining components, and they can be different from each other. In an embodiment, simple shapes for the floating wall elements may result in reduced stress in the floating wall element, which may in turn permit greater material choice. In an embodiment materials being considered include oxide dispersion strengthened alloys, which have superior heat properties, and single-crystal alloys for greater creep and fatigue strength. Also, should a floating wall element 38 sustain damage it can be switched out with a new one while the remainder of the wall assembly remains unchanged. Thus, repairs may be less costly.

Figure 2:
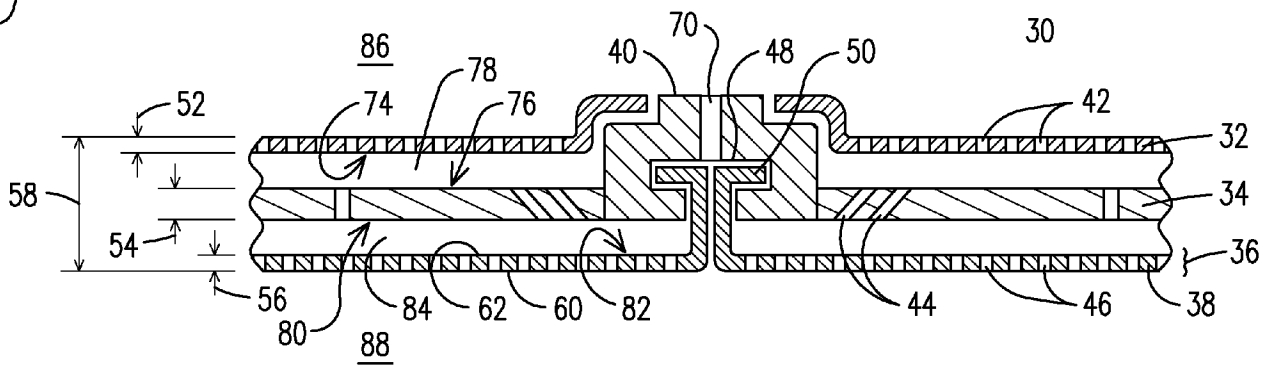
FIG. 2 is a cross section of the thermally isolated hot wall assembly.

A cross section of a wall assembly 30 can be seen in FIG. 2. The wall assembly 30 includes a structural cold wall 32, a structural middle wall 34, a floating wall 36 including at least one floating wall element 38, and a joining member 40. A structural cold wall inner side 74 and a structural middle wall outer side 76 partially define a first gap (or cavity) 78. A structural middle wall inner side 80 and a floating wall outer side 82 partially define a second gap (or cavity) 84. The structural cold wall 32 includes structural cold wall apertures 42 that transfer air from a region outside the wall assembly 86 to the first gap 78. The structural middle wall 34 includes structural middle wall apertures 44 that transfer air from the first gap 78 to the second gap 84. The floating wall elements include floating wall element apertures 46 that transfer air from the second gap 84 to a hot gas flow path 88. The structural cold wall 32 and the structural middle wall 34 are joined with a joining member 40. They may be welded, or bolted etc. The manner of connection is only relevant to the extent that it provide sufficient strength to the structural cold wall 32 and the structural middle wall 34. The joining member 40 has a geometric feature 48 which can receive a floating wall element engaging feature 50. A specific configuration of the geometric feature 48 and the floating wall element engaging feature 50 is not required. What is required is any configuration catches and "traps" permits the floating wall element 38 in such a manner that the floating wall element 38 is free to float, expand, and contract, yet remain engaged with the geometric feature 48. The geometric feature 48 may be elongated, such as a slot, so that individual floating wall elements can be removed and/or installed readily. The edges of the wall assembly 30 can be sealed and damped, or lead to other joining members 40 etc. Cooling can be provided as needed with dedicated cooling holes and/or intentional leakage of cooling air from outside the IEP 16 to inside, for example by joining member cooling aperture 70.

Structurally, the three walls are configured such that any mechanical load is isolated, or at least mostly isolated, from the floating wall elements 38. This means that in an embodiment the structural cold wall 32, the structural middle wall 34, and the joining member 40 may bear a majority of the pressure induced mechanical load. While a single, universally ideal mechanical load distribution is not envisioned, what is envisioned is the ability to partially or fully unload the floating wall element of pressure induced mechanical loads by configuring cooling holes in the components such that a structural cold wall pressure drop 52 and a structural middle wall pressure drop 54 are each (or both together are) greater than a floating wall element pressure drop 56. Specifically, the structural cold wall apertures 42 are of a number, size, and pattern etc that produce a relatively large structural cold wall pressure drop 52 compared to the floating wall element pressure drop 56. Similarly, the structural middle wall apertures 44 are of a number, size, and pattern etc. that produce a relatively large structural middle wall pressure drop 54 compared to the floating wall element pressure drop 56. The floating wall element pressure drop 56 is envisioned to be any value up to but not including 50% of the total pressure drop 58. In an embodiment the floating wall element pressure drop 56 is envisioned to be significantly lower than that, with the substantial majority of the total pressure drop 58 being borne by the structural cold wall 32, the structural middle wall 34, and the joining member 40. Between the structural cold wall 32, the structural middle wall 34, and the joining member 40 the majority of the structural load may be distributed in whatever manner is deemed most beneficial in terms of design and materials. In an embodiment the floating wall element pressure drop 56 may be on the order of 33% or less of the total pressure drop 58. In another embodiment the floating wall element pressure drop 56 may be on the order of 25% or less of the total pressure drop 58.

Thermal loads may be experienced in conventional transition configurations because material exposed to the combustion gasses may expand more than the structural components that support but simultaneously constrain the material exposed to the combustion gasses. The configuration disclosed herein mechanically unloads the floating wall elements 38, leaving it free to expand and contract unrestrained by the structural elements. As a result, thermal growth differences between the floating wall elements 38 and the structural elements do not produce stress in the floating wall elements 38. The reduction in thermal stress present in the floating wall elements 38 increases the material and design options for the floating wall elements 38. Specifically, the floating wall elements 38 may now be optimized for thermal performance characteristics.

ODS alloys may work extremely well in configurations such as in an IEP 16 because ODS alloys have superior thermal characteristics. However, it is difficult to produce ODS alloy components with complex geometry. Since the floating wall elements 38 may be of a simple geometry, the floating wall elements 38 may be made of ODS alloy without incurring unacceptable manufacturing losses. Similarly, the relatively simple geometry of the floating wall allows use of single crystal alloys which provide great creep and fatigue strength.

The structural cold wall 32 and the structural middle wall 34 can thus be configured to distribute the pressure related mechanical forces among themselves and the joining member 40 by designing and patterning their respective apertures to minimize or at least reduce cooling air there through. The structural cold wall 32 and the structural middle wall 34 may also, because they are exposed to lower temperatures, be designed using thermally inefficient shapes to enhance their strength.

The floating wall elements 38 may be cooled using cooling air that travels through the structural middle wall apertures 44. This may take the form of impingement cooling, where the cooling air is directed onto the floating wall elements 38 via the configuration and location of the structural middle wall apertures 44. That cooling air may then exit into the combustion gasses through the floating wall element apertures, such as film holes or slots.

Figure 3:
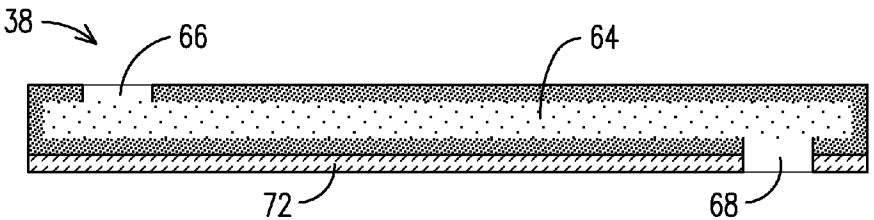
FIG. 3 is a cross section of an embodiment of a floating wall element with a cooling channel.

In a cross section of an alternate embodiment, as shown in FIG. 3, the floating wall element 38 may have a cooling channel 64 instead of film holes or slots. Cooling air may enter the cooling channel 64 via a cooling channel inlet 66, travel through the cooling channel 64, and exit through a cooling channel outlet 68. The cooling channel inlet 66 and the cooling channel outlet 68 may be offset from each other so that the cooling fluid does not travel straight through the floating wall element 38, but instead must turn, or redirect before exiting the floating wall element 38. The floating wall element 38 may be solid with a cooling channel 64 there through. Alternately the cooling channel 64 may be porous. A porous interior exposes more surface area to the cooling air, increasing cooling. The porous interior may be uniformly porous, or it may be non-uniformly porous. In an embodiment the cooling channel 64 may be more porous away from the surfaces of the floating wall element 38 and more porous toward the surfaces of the floating wall element 38. Such an embodiment is advantageous in that it may generate very high effective heat transfer resulting in minimizing floating wall element thermal gradients. Finally, the floating wall element may have a thermal barrier coating 72 added.

It can be seen that the inventor has devised an innovative solution to a problem resulting from the emergence of new gas turbine engine technology. This technology requires a single component to be able to withstand greater mechanical loads while simultaneously withstanding greater thermal loads. Not only does this wall assembly solve the problem associated with the emerging technology, but it is capable of withstanding structural and thermal loads beyond that which is required of the emerging technology, making it useful for applications with yet even greater mechanical and thermal load requirements. Yet the current wall assembly accomplishes this in a cost effective manner, and provides the further advantage that subsequent repairs are made easy and less expensive due to the modular nature of the floating wall elements.

The inventors envision the structure disclosed herein may be used in a variety of environments requiring structural and thermal capacity. Consequently, while the disclosure has focused on new technology such as the flow directing structure of FIG. 1, it is not meant to be limited to such an assembly. Any component lending itself to this structure may employ this structure and is considered to be within the scope of the disclosure. For example, but not limiting, conventional transitions could employ this structure, as could combustor liners etc.

While various embodiments of the present invention have been shown and described herein, it will be obvious that such embodiments are provided by way of example only. Numerous variations, changes and substitutions may be made without departing from the invention herein. Accordingly, it is intended that the invention be limited only by the spirit and scope of the appended claims.

The invention claimed is:

1. A wall assembly for separating a first fluid at a highest pressure and lowest temperature outside the wall assembly from a second fluid at a lowest pressure and highest temperature inside the wall assembly, the wall assembly comprising:

a structural cold wall comprising: an structural cold wall outer side for exposure to the first fluid; a structural cold wall inner side partially defining a first cavity outer boundary; and a structural cold wall aperture for creating a first pressure drop from the highest pressure to a high intermediate pressure within a first cavity;

a structural middle wall comprising: a structural middle wall outer side partially defining a first cavity inner boundary; a structural middle wall inner side partially defining a second cavity outer boundary; and a structural middle wall aperture for creating a second pressure drop from the high intermediate pressure to a low intermediate pressure within a second cavity; and a floating wall comprising: a floating wall outer side partially defining a second cavity inner boundary; a floating wall inner side for exposure to the second fluid; and a floating wall aperture for creating a third pressure drop from the low intermediate pressure within the second cavity to the lowest pressure, wherein the floating wall is cooled by impingement of fluid passing through the structural middle wall aperture.

2. The wall assembly of claim 1, wherein the third pressure drop is less than half of a sum of the first pressure drop and the second pressure drop.

3. The wall assembly of claim 1, further comprising:

a joining member attached rigidly to the structural cold wall and the structural middle wall;

a first geometric feature formed in the joining member; and a second geometric feature formed in the floating wall for cooperating with the first geometric feature to support the floating wall from the joining member while allowing the floating wall to move relative to the structural middle wall.

4. The wall assembly of claim 1, wherein the floating wall comprises a plurality of floating wall elements.

5. A wall assembly for a hot gas path, comprising:

a structural cold wall comprising structural cold wall apertures;

a structural middle wall comprising structural middle wall apertures;

a floating wall, comprising a plurality of floating wall elements each comprising floating wall element apertures, wherein the structural middle wall is disposed between the structural cold wall and the floating wall, and wherein a first gap exists between the structural cold wall and the structural middle wall, and a second gap exists between the structural middle wall and the floating wall; and a joining member configured to hold the structural middle wall relative to the structural cold wall, comprising a geometric feature, wherein the structural cold wall, the structural middle wall, and the joining member absorb a majority of a mechanical force generated by a pressure difference across the wall assembly, and wherein each floating wall element engages and is held in place by the geometric feature yet is free to expand and contract.

6. The wall assembly of claim 5, wherein the joining member and the structural cold wall bear the majority of the mechanical force.

7. The wall assembly of claim 5, wherein the structural cold wall apertures, the structural middle wall apertures, and the floating wall element apertures are configured to control pressure drops across respective walls, thereby producing a desired distribution of the mechanical force.

8. The wall assembly of claim 7, wherein the structural middle wall apertures are configured to provide impingement cooling of the floating wall element using cooling air passing there through.

9. The wall assembly of claim 5, wherein adjacent floating wall elements abut each other at the geometric feature.

10. The wall assembly of claim 5, wherein the geometric feature is a recess and wherein the recess widens from a recess opening to a recess base, forming a lip.

11. The wall assembly of claim 10, wherein each floating wall element comprises a lip engaging portion such that the lip engaging portion engages the lip and is thereby held in place.

12. The wall assembly of claim 10, wherein the recess is elongated.

13. The wall assembly of claim 5, wherein the floating wall element comprises a cooling fluid channel, and the floating wall element apertures comprise a cooling channel inlet on a floating wall element non-combustion gas side, and a cooling channel outlet on a floating wall element combustion gas side offset from a cooling channel inlet longitudinal axis, the cooling fluid channel connecting the cooling channel inlet and the cooling channel outlet.

14. The wall assembly of claim 13, wherein the cooling fluid channel comprises a porous structure.

15. The wall assembly of claim 14, wherein the porous structure varies in porosity.

16. The wall assembly of claim 15, wherein the porous structure is less porous in a floating wall element inner region and more porous in a floating wall element outer region.

17. The wall assembly of claim 5, wherein the floating wall element is an oxide dispersion strengthened alloy.

18. An integrated exit piece comprising the wall assembly of claim 5.

19. A wall assembly, comprising:

a structural cold wall comprising structural cold wall apertures;

a structural middle wall comprising structural middle wall apertures;

a floating wall comprising a floating wall element, the floating wall element defining at least part of a hot gas path and comprising floating wall apertures; and a joining member joining the structural cold wall and the structural middle wall, comprising a geometric feature, wherein the structural middle wall is disposed between and spaced apart from the structural cold wall and the floating wall;

wherein the floating wall element engages the geometric feature and is thereby held in place yet free to expand and contract in response to thermal changes, and wherein the floating wall bears less than half of a total pressure related mechanical load generated by a pressure difference across the wall assembly.

20. The wall assembly of claim 19, wherein the floating wall comprises a plurality of floating wall elements.

21. The wall assembly of claim 19, wherein the structural cold wall apertures, the structural middle wall apertures, and the floating wall apertures are configured to control pressure drops across respective walls, thereby producing a desired distribution of a mechanical force across respective walls.

22. The wall assembly of claim 19, wherein each floating wall element is impingement cooled by air flowing through the structural middle wall apertures.

23. The wall assembly of claim 19, wherein the geometric feature is a recess comprising a lip, and the floating wall element overlaps the lip.

24. The wall assembly of claim 19, wherein the floating wall element comprises a cold side inlet and a hot side outlet connected by a flow path, wherein air between the structural middle wall and the floating wall element enters the cold side inlet and exits the hot side outlet while undergoing at least one change in flow direction.

25. The wall assembly of claim 24, wherein the flow path comprises a porous material.

26. The wall assembly of claim 25, wherein the porous material varies in porosity, and is more porous proximate a floating wall element flow path longitudinal axis.

27. An integrated exit piece comprising the wall assembly of claim 19.

* * * * *